United States Patent [19]

Orton

[11] 4,427,414

[45] Jan. 24, 1984

[54] METHOD OF MAKING COLORED SHORT PILE FABRICS

[75] Inventor: Denis G. Orton, Williamsburg, Va.

[73] Assignee: Badische Corporation, Williamsburg, Va.

[21] Appl. No.: 367,482

[22] Filed: Apr. 12, 1982

[51] Int. Cl.[3] ..... D06P 5/00

[52] U.S. Cl. ..... 8/480; 8/481; 8/485; 8/529; 8/530; 8/534

[58] Field of Search ..... 8/529, 530, 481, 480, 8/534, 485

[56] References Cited

U.S. PATENT DOCUMENTS 3,352,624 11/1967 Harding et al. ..... 8/481
3,904,793 9/1975 Priester ..... 428/88
3,922,404 11/1975 Priester ..... 428/88
3,986,824 10/1976 Waibel et al. ..... 8/485
4,010,004 3/1977 Brown et al. ..... 428/92

FOREIGN PATENT DOCUMENTS 3022403 1/1981 Fed. Rep. of Germany .

*Primary Examiner*—A. Lionel Clingman
*Attorney, Agent, or Firm*—Rupert B. Hurley, Jr.

[57] ABSTRACT

Described herein is a process for the coloration of short pile fabrics, the process enabling the manufacture of various colors of pile fabric from a single intermediate fabric, the intermediate fabric having a precolored, undyeable, transparent face fiber.

10 Claims, No Drawings

METHOD OF MAKING COLORED SHORT PILE FABRICS

BACKGROUND OF THE INVENTION

The present invention is concerned with a process for making short pile fabrics, the process entailing a specific method of coloration of the fabric in order to achieve flexiblity in manufacturing different colors of fabric and in order to achieve a unique appearance, and in order to utilize undyeable fibers, such as homopolymer acrylic fibers.

Although applicant is not aware of any closely related published prior art, applicant is aware of some of the common practices in the manufacture of short pile fabrics. It is believed by applicant that in all prior art processes involving the manufacture of finished short pile fabrics by dyeing the backing material, the manufacturer attempted to color match the color of the backing to the color of the face fiber. In the instance in which the pile fiber was precolored and of differing eye affinity from the backing to which it was combined, manufacturers strive to dye the backing to the same color as that of the face fiber. Any resulting differences between the backing color and the face fiber color were believed to cause a "grinning through" of the backing, an undesirable effect. Although the manufacturers never perfectly match the backing color to the color of the face fiber, Table IV includes data to show how well the color matching process has succeeded in the prior art, as opposed to a lack of color matching, which is the subject of the present invention. Prior to the conception of the present invention, a lack of color matching was considered detrimental because it was considered to be a source of grinning through. This belief has been found to be true in the instance in which the face fiber is opaque, but it has unexpectedly been found that the use of a transparent face fiber does not require the matching of the color of the face fiber with the color of the backing material.

BRIEF SUMMARY OF THE INVENTION

It has been unexpectedly found that the manufacturer of velvet fabrics need not match the color of the backing with the color of the face fiber in the instance in which the face fiber is a transparent fiber. The use of a transparent face fiber allows a backing having a color which is different from the color of the face fiber to "add" to the color of the face fiber. This effect reduces the "grinning through" effect because the more two colors tend to add to one another, the less apparent is the difference in the two colors, to an observer.

In the process of the present invention, a precolored, undyeable, transparent face fiber is combined with a dyeable, undyed backing material to make an intermediate fabric. This intermediate fabric is then piece dyed so that the resulting fabric has a backing material which is of a different color from the color of the face fiber, the difference between the color of the backing and the color of the face fiber being greater than a certain amount (to be explained infra). The resulting color of the fabric is due to the "addition" of the color of the backing to the color of the transparent pile fiber. There are several advantages in the process of the present invention:

(a) The fabric producer may utilize advantageous but difficult-to-dye fibers such as homopolymer acrylic fibers.

(b) The fabric manufacturer may utilize precolored face fiber, precolored face fiber frequently yielding a cheaper process then piece dyeing both the backing and the face fiber.

(c) The fabric producer need not be concerned with closely matching the color of the dyed backing with the color of the precolored face fiber.

(d) The fabric manufacturer may stock a single intermediate product from which he can make any one or more of a wide variety of colors of finished fabric, in order to suit the needs of a particular customer.

DESCRIPTION OF THE PREFERRED EMBODIMENT

Although the present invention has many ramifications with respect to the coloration of fabrics by the utilization of transparent fibers, the present invention is concerned with the coloration of short pile fabrics, particularly velvets and velours. Of particular benefit from the present invention is the manufacturing process and product flexibility which the pile fabric producer may achieve by virtue of the fact that the present invention allows the producer to stock only one color of an intermediate fabric which he may then use to create any one or more of a plurality of colors of finished fabric which customers wish to purchase. Thus, by stocking a base of several colors of intermediate fabric, the producer will make available many more colors of finished fabric then would normally be available without having to do time consuming and tedious color matching between a colored face fiber and a backing material, and without having to make a commitment to a color which later becomes difficult to sell. By the process of the present invention, the fabric manufacturer may also utilize precolored (i.e. producer-colored) face fiber which allows a cheaper pile fabric production process. The process of the present invention is considered to be a process which is especially advantageous in the manufacture of short pile fabrics. The precoloring (i.e. coloring by the fiber manufacturer) of fiber (by both dyeing and pigmentation) has been found to be advantageous in that it allows the fiber producer to color by pigmentation (which cannot be done by the fabric manufacturer) which yields a product high in stability to sunlight. The process of the present invention may also be more economical in that dyeing is sometimes advantageous at a particular point in the process of producing the fiber. Furthermore, producer colored fiber is generally cheaper because the fiber is dyed after spinning (e.g. acrylic, nylon, etc.) but before being wound, so that no costs due to extra winding (as in package dyeing) are incurred.

The process of the present invention has been found to have utility on the basis of the fact that, in short pile fabrics, a transparent face fiber allows a change in the color of the fabric backing to change the apparent color of the face fiber. Although the transparency of a fiber is a matter of degree, any fiber capable of substantially altering its apparent color if formed into a short pile atop a substantially different colored backing is considered to be transparent enough to be included in the process of the present invention. As shown in Example II, an opaque fiber is considered inoperable for the present invention as the color of the backing does not blend with and is not added to the color of the face fiber.

In the most preferred embodiment of the present invention, the transparent face fiber is relatively lighter in color than the backing material. The relative darkness of the backing material, as compared with the pile fiber, creates a "richer" look as if the pile is deep enough to cause the effect of shadows within the pile layer. It has been found that a backing material which is substantially lighter in color (as compared with the depth of color of the pile fiber) causes a lack of "richness" and appears as "grin through," as the transparent face fiber does not blend as well with lighter backings as with darker backings. The coloration of the transparent pile fiber may be due to dying and/or pigmentation. Of course, if pigments are used to color the fiber, transparent pigments are necessary as substantial amounts of opaque pigments render the pile fiber unable to substantially alter its apparent color if formed into a pile atop a different colored backing. In making short pile fabrics in which the desired overall fabric color is medium or dark in relative depth, it is preferred that the transparent face fiber be precolored so that the color of the backing and the color of the face fiber are not so different that a "white-on-black" effect becomes very strong.

The process of the present invention is not limited to any particular group of polymers commonly used in the production of fiber. The only criteria necessary for the face fiber used in the process is that it be transparent. The color of the pile fiber may be either light or dark so long as it is transparent enough to have its apparent color substantially altered by a different colored backing material to which it has been affixed. Fibers such as, but not limited to, nylon, acrylic, polypropylene, and polyester are considered to be operable in the process of the present invention.

In the process of the present invention the pile fiber must be undyeable. The term undyeable is herein defined to mean the characteristic of being unable to darken to any desired depth of shade. In the process of the present invention, even though the pile fiber must be undyeable, it is sometimes "stained" by the dye used to color the backing material. The term staining is herein used to convey the characteristic of taking up relatively small amounts of the dye to which a particular fiber has been exposed. In contrast, a dyeable fiber takes up relatively large amounts of the dye to which it has been exposed. The process of the present invention is concerned with making an intermediate short pile fabric by combining an undyeable, transparent pile fiber with an undyed but dyeable backing material. As used herein, the word combining is meant to include any of the commonly known means of producing short pile fabrics (velvets and velours) including, but not limited to: weaving, warp knitting, raschel knitting, fine gauge tufting, circular knitting, flocking, and sliver knitting. After making the intermediate short pile fabric the backing material is then dyed with a selected dye so that the pile portion is not substantially affected. The "selected dye" is a dye which is chosen to dye the backing but leave the face fiber substantially unaffected (i.e. the pile fiber is not dyed, but is sometimes stained as described supra). In selecting a dye it is conceived that one of skill in the art of dyeing may either know of or may test any dye to see if it is suitable in the process of the present invention. Obviously, the choice of dye is dependent upon the chemical characteristic of the fibers making up the backing material and the pile.

The process of the present invention may utilize either a precolored (i.e. producer colored) or an uncolored pile fiber. In manufacturing darker shades of pile fabric by the process of the present invention, it has been found aesthetically pleasing to utilize a precolored, pile fiber as opposed to an uncolored pile fiber. However, in producing lighter shades (e.g. pastels) the face fiber need not be precolored but may be natural in color, or bleached, so long as the face fiber remains transparent.

It is especially advantageous to use the process of the present invention in order to stock intermediate fabric in situations in which it would be advantageous to have the capability to sell quantities of a fabric in a color which is to be determined immediately before delivery, or in other situations in which the desired colors are unknown or uncertain. For example, by stocking an intermediate fabric of light beige pile fiber on a white backing, any one of a number of shades of beige fabric or brown fabric may be produced simply by dyeing the backing the appropriate color so that both the color of the backing and the color of the face fiber yields the desired color—and this capacity includes the economic advantage of utilizing the cheaper, precolored, undyeable face fiber. Also, economic advantages may be realized in manufacturing a single lot of intermediate fabric which is then split into a plurality of portions of intermediate fabric, with each portion then being made into a different color so that savings due to precolored fiber may be realized in several colors produced by a single weaving or knitting operation.

The instant process contemplates making an intermediate fabric and a finished fabric. The intermediate fabric is comprised of a transparent, undyeable pile fiber in combination with an undyed but dyeable backing material. The finished fabric is comprised of a dyed backing material in combination with a transparent pile fiber.

Cotton is frequently used as a backing material in velvets. In this case, the use of nylon for the face fiber is precluded as nylon is dyed by cotton dyes. However, transparent acrylic, polypropylene and polyester fiber are suitable because they are not usually dyed by cotton dyes. From this it can be seen that in order to carry out the instant process, it is necessary that the fiber used in the face be different from the fiber used in the backing with respect to the effect of the dye.

The present invention is limited to short pile fabrics, especially velvet and velour fabrics. The present invention is conceived to include neither long pile fabrics such as furs nor very dense pile fabrics such as carpets. In the case of carpets and furs, the pile layer is so dense or long that the backing color does not add to the color of the face fiber.

The short pile fabrics used in Examples I and II were all manufactured by Baxter Kelley Corporation, P.O. Box 4088, Anderson, S.C., 29622. The fabric was a standard construction woven velvet. The fabric was 54 inches wide and had nine ounces per linear yard of precolored homopolymer acrylic fiber used as the pile fiber. The pile height was about 1/16 inces. The fabric had 34 picks per inch. The fabric had a cotton backing to which the pile was secured by means of a latex based adhesive. The total fabric weight was about 22-23 ounces per linear yard.

The following examples, unless otherwise specified, are intended to describe processes within the realm of the present invention

EXAMPLE I

A dyebath was prepared by dissolving anhydrous sodium sulfate (0.5 g), Tamol SN (0.125 g) and dyes in water (250 gm). A piece of velvet fabric (described above) 5 cm×20 cm, the fabric weighing approximately 5 grams, was stirred in the dyebath while the temperature was raised from 30° C. to 90° C. in twenty minutes and then maintained at 90° C. for another twenty minutes. The fabric was then removed, rinsed in cold water and dried in a tumble dryer.

Table I identifies the four samples and indicates the dye type and amount which was added to the dyebath for each sample:

TABLE I

| Sample | Dye Description | Wt. of dye (grams) |
|---|---|---|
| 1 | Chlorantine Fast Blue 8 GLL | 0.06 |
| | Chlorantine Fast Red 6 BLL | 0.04 |
| 2 | Chlorantine Fast Blue 8 GLL | 0.04 |
| | Chlorantine Fast Red 6 BLL | 0.02 |
| | Pyrazol Fast Yellow 5 GLL | 0.04 |
| 3 | Chlorantine Fast Blue 8 GLL | 0.016 |
| | Chlorantine Fast Red 6 BLL | 0.028 |
| | Pyrazol Fast Yellow 5 GLL | 0.056 |
| 4 | Chlorantine Fast Blue 8 GLL | 0.02 |
| | Chlorantine Fast Red 6 BLL | 0.04 |
| | Pyrazol Fast Brown C | 0.04 |

A series of spectrophotometric reflectance measurements was taken on Samples 1–5. Sample 5 and Sample 2 had backings which were deliberately dyed to match the color of the precolored face fiber. Samples 1, 3 and 4 had backings which were deliberately dyed colors which were different from the colors of the precolored face fiber. Samples 1–5 were of the same general construction (i.e. same pile height, backing yarn, pile density, etc.) Samples 1 and 5 had grey precolored homopolymer acrylic face fiber while Samples 2, 3 and 4 had beige precolored homopolymer acrylic face fiber.

In the colorimetric analysis of the pile fabrics, the pile fiber was shaved off of part of the fabric and the shavings were then packed into a 1 cm path polystyrene spectrophotometric cuvette, for measurement on a MacBeth M5 2000 spectrophotometer, using the small aperture. The color of the shaved backing and the color of the unshaven velvet fabric were measured on the same instrument using the large aperture. In all measurements the specular component was excluded and the mean of three readings was used. Color differences were calculated on the C.I.E.L.A.B. system using illuminent "C." The color difference referred to herein, $\Delta C$, is hereby defined as $(\Delta A^2+\Delta B^2)^{\frac{1}{2}}$ were $\Delta A$ and $\Delta B$ have the customary C.I.E.L.A.B. meanings. The color difference, $\Delta C$, excludes the component $\Delta L$. Delta L is a measurement of color depth.

Table II compares Sample 1 with Sample 5. Both samples were made using the same transparent precolored grey homopolymer acrylic face fiber, but Sample 1 had a violet colored backing while Sample 5 had a grey colored backing which had been dyed to match the color of the grey face fiber.

TABLE II

| Part of fabric | Color coordinate | COLOR COORDINATE VALUE Sample 1 | Sample 5 | Δ | ΔC |
|---|---|---|---|---|---|
| pile fiber | L | 54.3 | 55.73 | ΔL = 1.43 | 1.16 |
| | A | −0.04 | 0.14 | ΔA = 0.18 | |
| | B | 0.74 | 1.89 | ΔB = 1.15 | |
| backing | L | 37.53 | 43.55 | ΔL = 6.02 | 14.1 |
| | A | 5.97 | 1.82 | ΔA = −4.15 | |
| | B | −11.70 | 1.80 | ΔB = 13.50 | |
| total fabric | C | 32.66 | 36.64 | ΔL = 3.18 | 4.55 |
| | A | 0.84 | 0.47 | ΔA = −0.35 | |
| | B | −3.06 | 1.48 | ΔB = 4.54 | |

From Table II it can be seen that the color difference between the pile fiber of Sample 1 and the pile fiber of Sample 5 was very small ($\Delta C=1.16$). However, a comparison of the color of the total fabric yields a $\Delta C$ which was significantly larger ($\Delta C=4.55$). The total fabric color difference must therefore be attributed to the difference in the backing colors ($\Delta C=14.1$), as the backing color, in each case, "adds" to the color of the face fiber and therefore influences the total fabric color. A comparison of the color of the "undyeable" pile fiber would have rendered a $\Delta C=0$ if the dyes used did not stain the pile fiber. The fact that $\Delta C$ for the pile fiber ($\Delta C=1.16$) was not zero can be attributed to slight staining of the pile fiber and to experimental error. The comparison of Sample 1 with Sample 5 is intended to illustrate the addition of the color of the pile to the color of the backing. Both fabrics appeared to have a very even color, neither fabric exhibiting significant "grinning through."

In Table III, Samples 2, 3 and 4 were compared analytically. Sample 2 was used as a standard with respect to which one could compare Sample 3 with Sample 4. Sample 2 was used as a standard because the backing was intentionally dyed a color close to the color of the precolored beige face fiber. Sample 3 had an orange brown backing and Sample 4 had a red brown backing. Samples 2, 3 and 4 all had the same beige homopolymer acrylic pile fiber.

TABLE III

| Part of fabric | Color Coordinate | COLOR COORDINATE VALUE Sample 2 | Sample 3 | Δ #3–#2 | ΔC | COLOR COORDINATE VALUE Sample 4 | Δ #4–#2 | ΔC #4–#2 |
|---|---|---|---|---|---|---|---|---|
| Pile fiber | L | 57.08 | 58.59 | ΔL = 1.51 | | 58.58 | ΔL = 1.77 | |
| | A | 3.27 | 4.21 | ΔA = 0.94 | 2.11 | 6.12 | ΔA = 2.85 | 2.85 |
| | B | 22.61 | 24.50 | ΔB = 1.89 | | 22.55 | ΔB = −0.06 | |
| Backing | L | 42.16 | 44.58 | ΔL = 2.42 | | 40.01 | ΔL = 2.15 | |
| | A | 5.04 | 14.56 | ΔA = 9.52 | 10.75 | 17.43 | ΔA = 12.39 | 16.5 |
| | B | 22.15 | 27.13 | ΔB = 4.98 | | 11.24 | ΔB = −10.91 | |
| Total | L | 36.93 | 39.23 | ΔL = 2.30 | | 35.86 | ΔL = −1.68 | |
| | A | 6.23 | 9.64 | ΔA = 3.41 | 4.00 | 11.12 | ΔA = 4.85 | 5.13 |
| | B | 25.41 | 27.51 | ΔB = 2.10 | | 23.73 | ΔB = −1.68 | |

Table III shows color coordinate values for Samples 2, 3, and 4, the values being obtained for the face fiber alone, the backing alone, and the total fabric. Delta values (i.e. ΔA, ΔB, and ΔL) were calculated from the color coordinate values by subtracting the corresponding color coordinate values of Sample 2 from both the Sample 3 values and the Sample 4 values. The values for ΔC were calculated using the inter-sample Δ values. Just as was found in Table II, the values in Table III indicate that the backing coloration affected the total fabric coloration. Furthermore, Table III shows how several colors may be made from an intermediate fabric having a given face fiber color. As in Samples 1 and 5, Samples 2, 3 and 4 appeared very uniform in color and did not exhibit any grin through. Samples 2, 3 and 4 had distinctly different tints, in that the total fabric color of Sample 2 was a beige brown, Sample 3 was a pink beige, and Sample 4 was an orange beige.

TABLE IV

| Sample # | Face fiber color | ΔA | ΔB | ΔC |
|---|---|---|---|---|
| 1 | grey | 6.01 | −12.44 | +13.8 |
| 2 | beige | 1.77 | −0.46 | +1.83 |
| 3 | beige | 10.35 | +2.63 | +10.7 |
| 4 | beige | 11.31 | −11.31 | +16.0 |
| 5 | grey | 1.68 | −0.09 | +1.68 |

As Tables II and III have shown inter-sample color differences, Table IV shows intra-sample color differences for Samples 1–5. The ΔA and ΔB values were calculated from the color coordinate values taken from the pile fiber and the backing material of the same fabric. The ΔC which was calculated from the ΔA and ΔB values is therefore an indicator of the degree of color difference between the face fiber and the backing material of the same fabric. As can be seen from Table IV, Samples 2 and 5 had backings which closely resembled the color of the face fiber (ΔC=1.83, +1.68 respectively). Conversely, Samples 1, 3 and 4 had backings which were intentionally dyed so that the resulting fabric had a large difference between the color of the backing material and the color (ΔC=13.8, 10.7, 16.0 respectively) of the face fiber. As was stated supra, in the prior art manufacturers attempted to match the color of the backing with the color of the face fiber in order to prevent grinning through. It is believed by applicants that the match obtained was never perfect but was probably always closer than a ΔC of 3.0 (i.e. ΔC<3.0), the ΔC being the difference in the color of the backing as compared with the color of the face fiber. For the purposes of the present invention, an intra-sample ΔC of greater than 4.0 is considered to be within the process disclosed.

EXAMPLE II

This example is intended to illustrate a negative embodiment of the present invention. Furthermore, this example is intended to illustrate the necessity for using a transparent pile fiber in the process of the present invention.

Two pieces of velvet were obtained (Samples 6 and 7), each with an undyed white cotton backing and a white pile fiber. The general fabric construction was the same as Samples 1–5, except that Sample 6 had transparent homopolymer acrylic pile fiber while Sample 7 had a pile fiber which was made from an acrylic copolymer containing 0.57% titanium dioxide (the pile fiber of Sample 7 was opaque). Sample 7 was dyed in a dye bath (described supra) with 0.10 grams Pyrazol Fast Brown C added to the dye bath.

A spectrophotometric analysis was performed on Sample 6 and Sample 7, the results of which are shown in Table V:

TABLE V

| Part of Fabric | Color Coordinate | COLOR COORDINATE VALUES Sample 6 | Sample 7 | Δ | C ΔC |
|---|---|---|---|---|---|
| Pile fiber | L | −84.96 | −88.76 | ΔL = 3.80 | 3.4 |
| | A | −1.62 | +1.48 | ΔA = +3.10 | |
| | B | 8.15 | +9.55 | ΔB = +1.40 | |
| Backing | L | 77.12 | 42.24 | ΔL = −34.88 | 19.5 |
| | A | −0.13 | 17.16 | ΔA = 17.29 | |
| | B | 9.04 | 18.36 | ΔB = 9.32 | |
| Total Fabric | L | 79.72 | 76.51 | ΔL = −3.21 | 3.3 |
| | A | −1.66 | 0.03 | ΔA = +1.69 | |
| | B | 7.67 | 5.27 | ΔB = 2.40 | |

From the inter-sample C values shown, the total fabric color difference (ΔC=3.3) was essentially equal to the pile fiber color difference (ΔC=3.4) even though the backing color difference was very great (ΔC=19.5). It is evident that an opaque pile fiber (Sample 7) obscured the brown backing, so that the apparent fabric color remainded white. Furthermore, Sample 7 exhibited a very objectionable amount of "grinning through" of the brown backing.

We claim:

1. A process of manufacturing short pile fabrics, comprising the steps of:
(a) combining a transparent face fiber with a backing material so that an intermediate fabric is produced, the backing material being dyeable with a selected dye and the face fiber being undyeable with the selected dye;
(b) dyeing the intermediate fabric with the selected dye so that a resulting finished short pile fabric has a backing of a first color and a transparent pile fiber of a second color, the backing color differing from the pile fiber color by a ΔC of at least 4 units as measured by the C.I.E.L.A.B. color order system, the combination of the backing and the transparent pile fiber yielding a finished short pile fabric of a third color.

2. A process of manufacturing short pile fabrics as described in claim 1 wherein the backing color differs from the pile fiber color by a ΔC of at least 6 units.

3. A process of manufacturing short pile fabrics as described in claim 1 wherein the backing color differs from the pile fiber color by a ΔC of at least 10 units.

4. A process as described in claim 1 or 2 or 3 wherein the transparent face fiber is precolored.

5. A process as described in claim 1 or 2 or 3 wherein a velvet fabric is made from transparent face fiber comprised of precolored homopolymer acrylic fiber and a backing material comprised of cotton fiber.

6. A process of making a plurality of colors of short pile fabrics, comprising the steps of
(a) combining a transparent face fiber with a backing material so that an intermediate fabric is produced, the backing material being dyeable with any one of a plurality of selected dyes and the face fiber being undyeable with any one of the plurality of selected dyes;
(b) separating the intermediate short pile fabric into a plurality of portions;
(c) dyeing each portion of the intermediate fabric with one of the selected dyes so that a plurality of finished short pile fabrics are produced, each of the finished fabrics having a backing of a first color and a transparent pile fiber of a second color so that the finished fabric is of a third color, in each portion of finished fabric the first color differing from the second color by a ΔC of at least 4 as measured by the C.I.E.L.A.B. color order system.

7. A process as described in claim 6 wherein each portion of finished fabric has a first color differing from a second color by a ΔC of at least 6 as measured by the C.I.E.L.A.B. color order system.

8. A process as described in claim 6 wherein each portion of finished fabric has a first color differing from a second color by a ΔC of at least 10 as measured by the C.I.E.L.A.B. color order system.

9. A process as described in claim 6 or 7 or 8 wherein the short pile fabrics are velvet fabrics.

10. A process as described in claim 6 or 7 or 8 wherein the short pile fabrics are velvet fabrics having pile fiber which is comprised of homopolymer acrylic fiber and backing material which is comprised of cotton fiber.

* * * * *